US007381294B2

(12) United States Patent
Suzuki et al.

(10) Patent No.: US 7,381,294 B2
(45) Date of Patent: Jun. 3, 2008

(54) METHOD AND APPARATUS FOR MANUFACTURING MICROFIBRILLATED CELLULOSE FIBER

(75) Inventors: Migaku Suzuki, Kanagawa (JP); Yutaka Hattori, Shizuoka (JP)

(73) Assignee: Japan Absorbent Technology Institute, Tokyo (JP)

( * ) Notice: Subject to any disclaimer, the term of this patent is extended or adjusted under 35 U.S.C. 154(b) by 459 days.

(21) Appl. No.: 10/516,090

(22) PCT Filed: Jul. 15, 2003

(86) PCT No.: PCT/JP03/08974

§ 371 (c)(1),
(2), (4) Date: Nov. 30, 2004

(87) PCT Pub. No.: WO2004/009902

PCT Pub. Date: Jan. 29, 2004

(65) Prior Publication Data

US 2005/0194477 A1 Sep. 8, 2005

(30) Foreign Application Priority Data

Jul. 18, 2002 (JP) ..... 2002-209548

(51) Int. Cl.
*D21D 1/30* (2006.01)

(52) U.S. Cl. ..... 162/9; 162/102; 162/157.6; 162/187; 162/261

(58) Field of Classification Search ..... 162/9, 162/100, 102, 146, 149, 157.6, 261, 187; 536/56; 241/21, 28
See application file for complete search history.

(56) References Cited

U.S. PATENT DOCUMENTS

| | | | | |
|---|---|---|---|---|
| 4,374,702 | A * | 2/1983 | Turbak et al. | 162/100 |
| 5,240,561 | A * | 8/1993 | Kaliski | 162/138 |
| 5,385,640 | A * | 1/1995 | Weibel et al. | 162/23 |
| 6,183,596 | B1 * | 2/2001 | Matsuda et al. | 162/9 |
| 6,214,163 | B1 | 4/2001 | Matsuda et al. | |
| 6,506,435 | B1 * | 1/2003 | Lundberg et al. | 426/578 |

FOREIGN PATENT DOCUMENTS

| | | |
|---|---|---|
| JP | A 7-301938 | 11/1995 |
| JP | A 7-310296 | 11/1995 |
| JP | A 11-106403 | 4/1999 |
| JP | A 2000-17592 | 1/2000 |
| JP | A 2000-250174 | 9/2000 |
| JP | A 2003-155349 | 5/2003 |

* cited by examiner

*Primary Examiner*—Eric Hug
(74) *Attorney, Agent, or Firm*—Oliff & Berridge, PLC

(57) ABSTRACT

A method for producing a microfibrillated cellulose, which comprises subjecting a slurry containing a pulp having a solids concentration of 1 to 6 wt % to the treatment with a disc refiner repeatedly ten times or more, to thereby prepare a microfibrillated cellulose having a number average fiber length or 0.2 mm or less and an amount of water hold of 10 mL/g or more, the amount representing the volume of water capable of being held by a unit weight of the cellulose fiber. The method allows the production of a microfibrillated cellulose having high quality with stability and with good efficiency.

12 Claims, 6 Drawing Sheets

METHOD AND APPARATUS FOR MANUFACTURING MICROFIBRILLATED CELLULOSE FIBER

TECHNICAL FIELD

The present invention relates to methods and apparatuses for manufacturing microfibrillated cellulose (MFC) fibers whose properties-are utilized in a wide range of industrial fields including paper manufacturing, paints industry, membrane manufacturing, food industry and cosmetics fields, and in particular, most suitable as a bonding agent and dispersion agent for highly absorbent polymers in such products as sanitary articles utilizing highly absorbent polymers.

BACKGROUND ART

Microfibrillated cellulose fibers consist of a part or the whole of the fibers having extremely fine fibers, of specifically tens of cellulose chains thereof having the fineness of microfibrill level. So far, various methods for manufacturing microfibrillated cellulose fibers have been proposed. For example, a method of obtaining bacteria cellulose by fermentation using of acetobacter, a method for making pulp into microfibrillated fibers also using an abrasive grinding apparatus (JP 7-310296 A), and a method for treating pulp for a long period of time using a high pressure homogenizer have been proposed.

Any of such methods, however, requires a specially designed equipment and high energy, and the properties of the resulting final products are not consistent. At present, no method of continuously manufacturing microfibrillated cellulose fibers for an industry has been realized yet.

Note that in the paper manufacturing field, as a high efficiency beating and fibrillating machine, disc refiners such as a single disc refiner and a double disc refiner (hereinafter "DDR") are widely and generally used. Attempts have been made to obtain more finely microfibrillated cellulose fibers using the disc refiners. An example is a process of making highly beaten and fibrillated pulp which is used as a raw material for parchment paper.

In the above-mentioned process, however, it has been said that it is difficult to reach the micro refined level of microfibrillated cellulose fibers. Besides, no reports have been made that MFC has been obtained by means of a disc refiner.

DISCLOSURE OF THE INVENTION

The present invention relates to a method and an apparatus for manufacture of microfibrillated cellulose fibers, enabling a stable and efficient production thereof.

That is to say, the present invention provides the following (1)~(15).

(1) A method for the manufacture of microfibrillated cellulose fibers of 0.2 mm or less in terms of number average fiber length and of 10 mL/g or more in terms of water retention indicating the volume of water which can be retained by a unit weight of cellulose fibers, by subjecting slurry containing pulp of solid component concentration of 1 to 6 wt % to treatment with a disc refiner at 10 times or more.

(2) A method for the manufacture of microfibrillated cellulose fibers according to (1) above, wherein said treatment with a disc refiner is performed 30 to 90 times.

(3) A method for the manufacture of microfibrillated cellulose fibers according to (1) or (2) above, wherein the number average fiber length of said microfibrillated cellulose fibers is 0.1 to 0.2 mm and the water retention of said microfibrillated cellulose fibers is 25 to 35 mL/g.

(4) A method for the manufacture of microfibrillated cellulose fibers according to any one of (1) to (3) above, wherein the solid component concentration of said slurry is 1 to 4 wt %.

(5) A method for the manufacture of microfibrillated cellulose fibers according to (4) above, wherein said slurry is slurry obtained by dilution with ethanol or a mixture of ethanol and water.

(6) A method for the manufacture of microfibrillated cellulose fibers according to any one of (1) to (5) above, wherein one disc refiner is employed.

(7) A method for the manufacture of microfibrillated cellulose fibers according to any one of (1) to (5) above, wherein two disc refiners are employed and the total number of treatments with a first disc refiner and with a second disc refiner is 10 times or more, wherein after one time or more of said treatments with the first disc refiner are performed, one time or more of said treatments with the second disc refiner are performed.

(8) A method for the manufacture of microfibrillated cellulose fibers according to any one of (1) to (5) above, wherein two disc refiners are employed and the total number of treatments with a first disc refiner and with a second disc refiner is 10 times or more, wherein an operation in which after one time of said treatment with the first disc refiner is performed, one time of said treatment with the second disc refiner is performed is repeated 5 times or more.

(9) A method for the manufacture of microfibrillated cellulose fibers according to (7) or (8) above, wherein said first disc refiner and said second disc refiner are of the same type.

(10) A method for the manufacture of microfibrillated cellulose fibers according to (7) or (8) above, wherein said first disc refiner and said second disc refiner are different in at least one selected from a group consisting of the blade width, the groove width and the ratio of blade width to groove width of disc plate.

(11) A method for the manufacture of microfibrillated cellulose fibers according to any one of (1) to (10) above, wherein as said disc refiner, a disc refiner having a disc plate of 3.0 mm or less blade width and 1.0 or less ratio of blade width to groove width is employed.

(12) A method for the manufacture of microfibrillated cellulose fibers according to (10) above, wherein as said first disc refiner, a disc refiner having a disc plate of 2.5 mm or less blade width and 1.0 or less ratio of blade width to groove width is employed and as said second disc refiner, a disc refiner having a disc plate of 2.5 mm or more blade width and 1.0 or more ratio of blade width to groove width is employed.

(13) Microfibrillated cellulose fibers obtainable by the method for the manufacture of microfibrillated cellulose fibers according to any one of (1) to (12) above, wherein the number average fiber length is 0.2 mm or less and the water retention indicating the volume of water which can be retained by cellulose fibers of a unit weight is 10 mL/g or more.

(14) An apparatus for the manufacture of microfibrillated cellulose fibers, provided with a defibrating device, a circulation bath connected to said defibrating device, a disc refiner having an inlet and an outlet with said inlet being connected to said circulation bath, and a reservoir bath connected to said outlet of said disc refiner, the outlet of said disc refiner being also connected to said circulation bath, wherein said defibrating device defibrates supplied pulp sheets into slurry, said circulation bath temporarily stores the slurry, said disc refiner treats said slurry supplied from said circulation bath, said slurry treated with said disc refiner is supplied to said circulation bath, and then said slurry is supplied to said disc refiner, whereby the treatment with said disc refiner is performed cyclically, and after the treatment is performed 10 times or more, said slurry is supplied to said reservoir bath at a prescribed timing.

(15) An apparatus for the manufacture of microfibrillated cellulose fibers, provided with a defibrating device, a disc refiner having an inlet and an outlet with said inlet being connected to said defibrating device, and a reservoir bath connected to said outlet of said disc refiner, the outlet of said disc refiner being also connected to said defibrating device, wherein said defibrating device defibrates supplied pulp sheets into slurry, said disc refiner treats said slurry supplied from said defibrating device, said slurry treated with said disc refiner is supplied to said defibrating device, and then said slurry is supplied to said disc refiner, whereby the treatment with said disc refiner is performed cyclically, and after the treatment is performed 10 times or more, said slurry is supplied to said reservoir bath at a prescribed timing.

By a method for the manufacture of microfibrillated cellulose fibers according to the present invention, microfibrillated cellulose fibers of good quality can be manufactured stably and efficiently.

In addition, an apparatus for the manufacture of microfibrillated cellulose fibers according to the present invention is very suitable for a method for the manufacture of microfibrillated cellulose fibers according to the present invention.

BEST MODE FOR CARRYING OUT THE INVENTION

Figure 1:
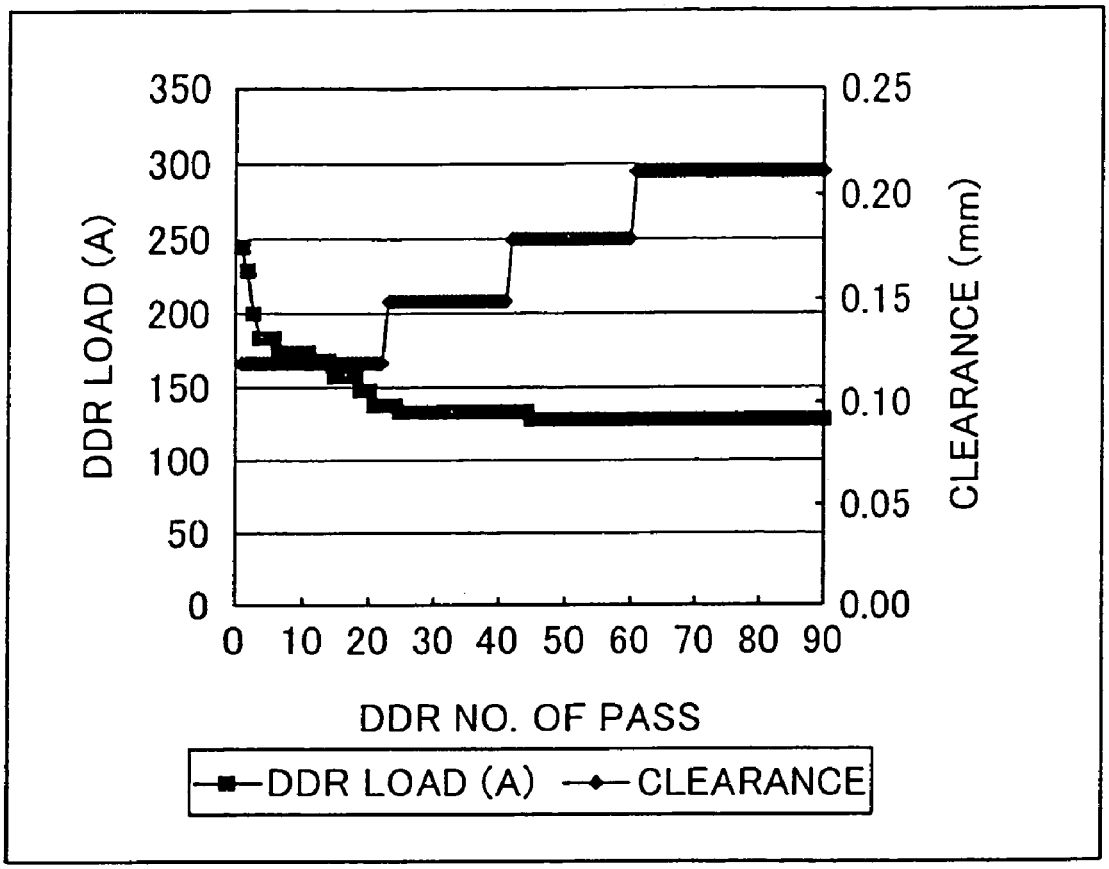
FIG. 1 is a chart showing an example of the relation between the number of passes of DDR and the load and clearance of DDR.

The present invention will be explained in detail below:

<Slurry>

In a method for the manufacture of microfibrillated cellulose fibers according to the present invention, a slurry containing a pulp whose solid component concentration is 1 to 6 wt % is used as a raw material.

The pulp contained in the slurry has no particular limitation, but a wood pulp of a general use is preferably used.

Wood pulp is classified broadly into coniferous tree (N wood) pulp of relatively long fiber lengths and broad leaf tree (L wood) pulp of relatively short fiber lengths. Either of these pulps may be used in the present invention, but L wood pulp of shorter fiber lengths is preferable. Specifically, LBKP (broad leaf kraft pulp) is more preferably used.

In addition, wood pulp is broadly classified in terms of whether it is beaten and fibrillated or not, and classified into unbeaten such as virgin pulp and beaten and fibrillated pulp. In the present invention, either of these pulps can be used. As beaten and fibrillated pulp, a waste paper pulp made from a waste paper as a raw material can also be used, but it should preferably contain neither a printing ink nor a sizing agent. A preferable beaten and fibrillated pulp is, for example, a beaten and fibrillated pulp for facial tissue paper and toilet paper.

Slurry contains one of the above-mentioned pulps whose solid component concentration is 1 to 6 wt %. Here, "solid component concentration" means the weight ratio of pulp to the whole slurry. The term "solid component concentration" may also be referred to as "concentration".

If a treatment is performed to a slurry using a disc refiner as described later, the viscosity of the slurry is increased 10 to 20 times that before such treatment is performed. If the viscosity is too high, air caught up by agitation or circulation of liquid remains as air bubbles, which, if increased in volume, may cause a pump to cavitate. Also, problems such as accumulation of friction heat and troubles in pump transfer are likely to occur. Therefore, in the present invention, the concentration of the slurry is 6 wt % or less, preferably 5 wt % or less and more preferably 4.5 wt % or less.

On the other hand, if the concentration of the slurry is too low, friction between fibers becomes small, and the efficiency of treating with a disc refiner is lowered, and as a result, the treatment efficiency of the whole equipment is also lowered, so in the present invention, the concentration of the slurry is 1 wt % or more, preferably 1.5 wt % or more and more preferably 2 wt % or more.

Methods for the preparation of a slurry is not particularly limited, but since generally, a commercial pulp is available in a sheet form, such pulp is preferably defibrated first.

Defibration is a treatment to disperse a pulp sheet in water. For defibration, a defibrating device as is generally used in the paper manufacturing industry can be used in the present invention. As such a defibrating device, for example, a pulper, which is a defibrating device provided with a strong agitator, and a beater, which is a defibrating device capable of defibrating as well as beating and fibrillating at the same time, can be used in the present invention.

Defibration by a pulper is preferably performed under the condition that the concentration of the slurry is made to be 5 to 10 wt %. Therefore, in order to obtain a slurry whose concentration is 1 to 6 wt %, it is one of the preferred modes that water dispersion liquid obtained by defibration is diluted to be used. The water dispersion liquid is preferably diluted to 1 to 4 wt %.

Specifically, in case a pulper is used, a method by diluting and agitating is preferable. In this case, as a pulper, a large capacity apparatus for the quantity of slurry to be defibrated may be used, and an apparatus prepared by modifying a usual capacity pulper such that a diluting space is provided for example above the pulper may be used.

In using a water dispersion liquid obtained by defibration, a liquid used for dilution may not only be water, but also, ethanol or a mixture liquid of ethanol and water may be used. If dilution is performed using ethanol or a mixture liquid of ethanol and water, the viscosity may be lowered and in the later described treatment with a disc refiner, the transferability by a pump can be improved. In addition, defoaming effects can be obtained.

The mixture liquid of ethanol and water is not particularly limited in terms of the mixing ratio, and for example, the mixing ratios may be ethanol/water=50/50 to 80/20.

By diluting with ethanol or a mixture liquid of ethanol and water, the ratio of ethanol to water in the slurry is required to be lower than the ignition limit. Specifically, the ratio of ethanol is preferably 50 wt % or less or more, preferably 30 wt % or less based on the total of ethanol and water.

<Treatment with Disc Refiner>

In a method for the manufacture of microfibrillated cellulose fibers according to the present invention, a treatment with a disc refiner is repeated 10 times or more. In some cases, it is preferable to repeat the treatment 20 times or more and more preferable to repeat the treatment 30 to 90 times.

A disc refiner has disc plates having blades for beating and fibrillating as facing to each other at a very near distance wherein one of the disc plates rotates or both plates rotate in a reverse direction to each other, and the slurry containing pulp passes between both blades to be beaten and fibrillated under pressure.

As a disc refiner, a single disc refiner with a single clearance gap for beating and fibrillating formed by disc plates and a double disc refiner with two clearance gaps for beating and fibrillating formed by disc plates are available. In the present invention, a conventional well known disc refiner can be used. Note that in general, in case a DDR is used, the number of treatments is approximately half of that in case a single disc refiner is used, and this makes the use of the DDR efficient.

In the treatment with a disc refiner, one disc refiner is sufficient, but a multiple of the same type disc refiners may be used and multiple of different type disc refiners may be used.

For example, it is preferable to use a combination of a first disc refiner and a second disc refiner. Specifically, for example, a method that, first, one or more treatments are done with the first disc refiner, and then one or more treatments are done with the second disc refiner, thereby the treatment with the disc refiner is done 10 times or more in total and a method that the operation of the treatment with the first disc refiner being done once followed by the treatment with the second disc refiner being done once is repeated 5 times or more, thereby the treatment with the disc refiner is done 10 times or more in total are available.

The conditions for treating with a disc refiner are appropriately selected depending upon the characteristics of microfibrillated cellulose fibers which will be explained. Such conditions are, for example, kinds of disc plates used, concentrations of slurries, flow rates, inlet pressures and outlet pressures, positions of blade (clearance) and load. The load, however, is decreased as the number of times of treatment is increased and the degree of microfibrillation is advanced, and if the number of times of treatment reaches some level, the load becomes identical with that in the case disc plates are operated in the released state. Note that the indication of loads of disc refiners depends upon the kinds of apparatuses, expressed either in electric power (kW) or in electric current (A).

FIG. 1 is a chart showing an example of the relation between the number of times of pass of DDR and the load and the clearance of DDR (FIG. 1 indicates the results of example 4 which is taken up later). As shown in FIG. 1, the load becomes identical with that in the case disc plates operated in the released state as the number of times of treatment is increased. In other words, as the number of times of treatment is increased, no electric current beyond a certain value can be applied even if the clearance is made small. Therefore, it is difficult to control the degree of microfibrillation of fibers based on the value of the load.

On the other hand, according to a study by the inventors, it was found that as the number of times of pass of DDR is increased, the degree of microfibrillation of fibers is progressed even if the load stays same.

The inventors assumes that this implies that, as the number of passes of DDR is increased and thus the microfibrillation of fibers progresses, not only cutting of fibers and the resulting microfibrillation of fibers take place as the fibers get in contact with the disc plates of a disc refiner but also due to shearing caused by fibers getting in contact with each other as the slurry is made to pass at a high speed through the narrow gap, the microfibrillation of fiber is further advanced. And this shearing can be controlled by adjusting the clearance.

Thus, in the present invention, the degree of microfibrillation of fibers is preferably controlled not by the load of the disc refiner but by the clearance (indicated on the disc refiner).

Among the above-mentioned conditions, in order to obtain desired characteristics of microfibrillated cellulose fibers, important are the blade width, the groove width and the ratio of the blade width to the groove width of the disc plate.

For example, in case of efficiently making cellulose fibers into short and fine form is intended, a disc plate with a narrow blade width and a wide groove width is preferable. Specifically, the blade width is preferably 3.0 mm or less, the groove width is preferably 3.0 mm or more, and the ratio of blade width to groove width (hereinafter also called "blade width/groove width ratio") is preferably 1.0 or less.

On the other hand, in case it is an objective to perform grinding-by-friction and gelation efficiently, a disc plate preferably has a wide blade width and a narrow groove width. Specifically, the width of blade is preferably 3.0 mm or more, the ratio of blade width to groove width is preferably 1.0 or more, and the width of groove is preferably 2.5 mm or less.

In case one disc refiner or multiple of disc refiners of the same type is or are used, for example, the width of blade is preferably 1.0 to 4.0 mm and the width of groove is preferably 2.0 to 8 mm.

Above all, when one disc refiner is used and treatment is performed for a relatively long period of time, for example, the treatment is performed for 4 to 5 hours 30 times or more, if, for example, a disc plate with 1.5 mm width of blade and 3.0 mm groove width is selected and under a condition that the clearance is relatively large, it may take a relatively long period of time but can be controlled relatively easily.

In case two disc refiners, i.e., a first disc refiner and a second disc refiner, are used, if the disc refiners are of the same type, although the numbers of times of treatments may be increased, the treatment conditions may be controlled easily and the apparatuses may be maintained easily, and it has the advantage of requiring only a small number of types of spare parts.

On the other hand, in case two disc refiners, i.e., a first disc refiner and a second disc refiner, are used, the first disc refiner and the second disc refiner are different in at least one condition selected from a group consisting of the blade width, the groove width and the ratio of the blade width to the groove width of the disc plate, although it would be complicated with the necessities of condition control, the apparatus maintenance and required spare parts, the number of treatments may advantageously be decreased by appropriately changing such necessities.

In the latter case, specifically, preferably, a disc refiner with disc plates of 2.5 mm or less blade width and 1.0 or less ratio of blade width to groove width is used as a first disc refiner and a disc refiner with disc plates of 2.5 mm or more blade width and 1.0 or more ratio of blade width to groove width is used as a second disc refiner. Also, the disc plates of the first disc refiner has preferably 3.0 mm or more groove width, and the disc plate of the second disc refiner has preferably 2.5 mm or less groove width. For example, the combinations as given in Table 1 are available:

TABLE 1

| | Disc plate | | |
|---|---|---|---|
| | Blade width (mm) | Groove width (mm) | Ratio of blade width to groove width |
| First disc refiner | 2.0 | 3.0 | 0.67 |
| Second disc refiner | 3.5 | 2.0 | 1.75 |

As result of performing the treatment with a disc refiner 10 times or more, microfibrillated cellulose fibers of 0.2 mm or less number average fiber length and 10 mL/g or more water retention may be obtained.

Figure 2:
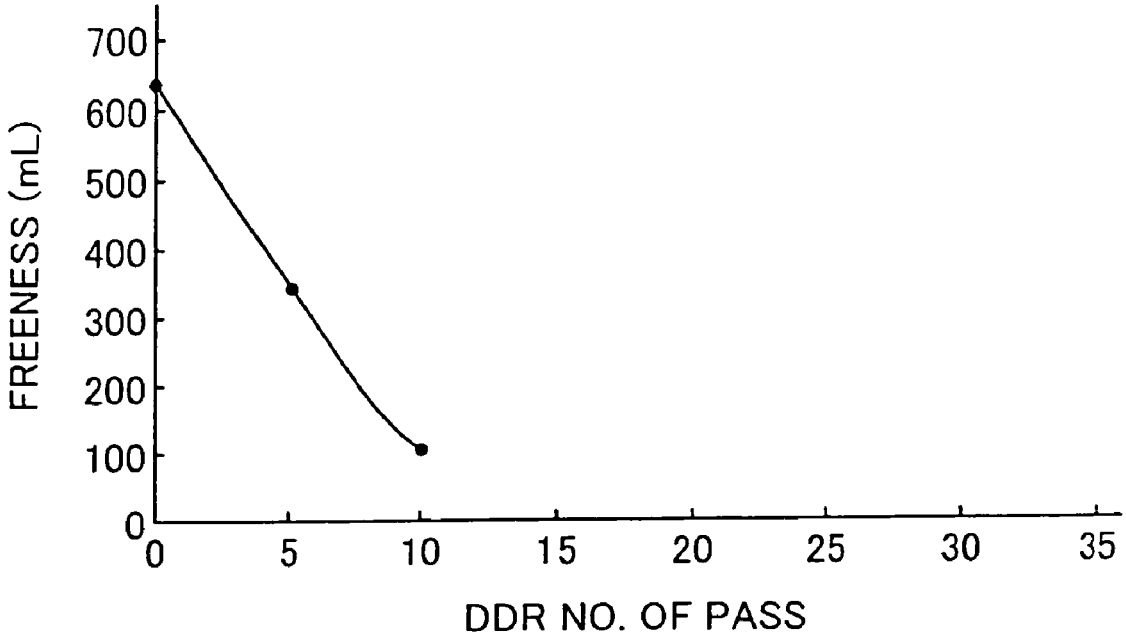
FIG. 2 is a chart showing an example of the relation between the number of passes of DDR and the freeness of obtained cellulose fibers.
Figure 3:
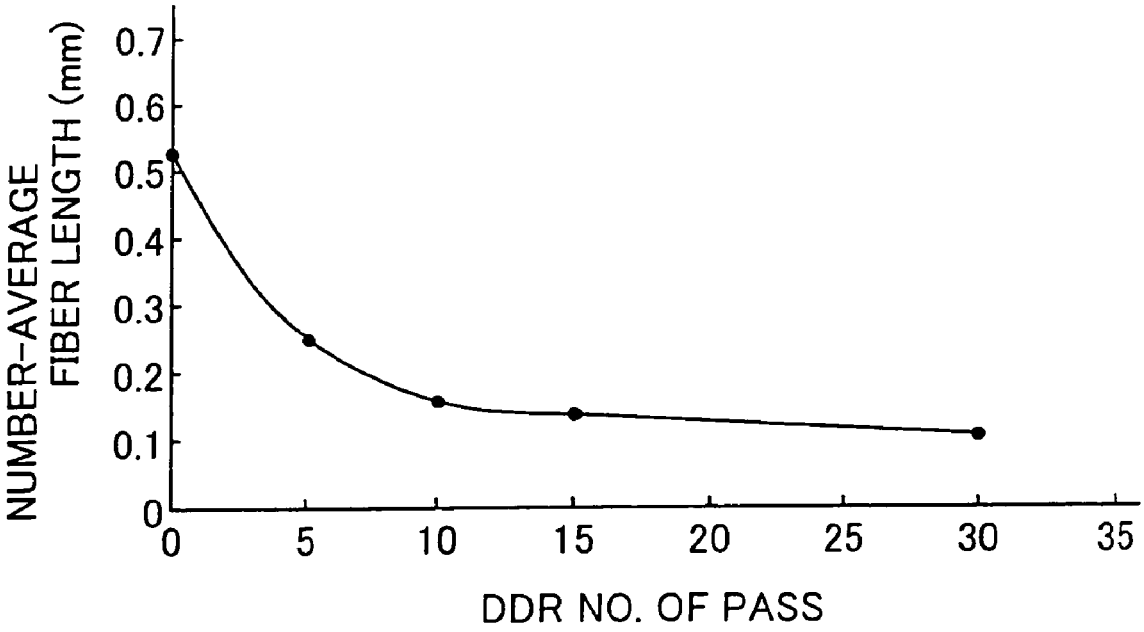
FIG. 3 is a chart showing an example of the relation between the number of passes of DDR and the number average fiber length of obtained cellulose fibers.
Figure 4:
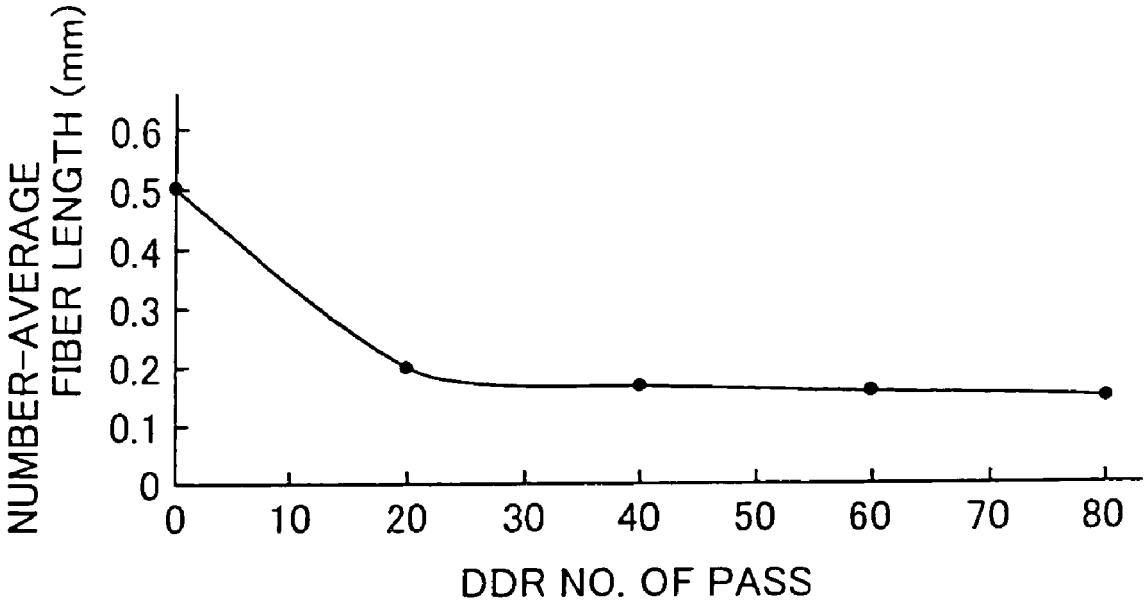
FIG. 4 is a chart showing another example of the relation between the number of passes of DDR and the number average fiber length of obtained cellulose fibers.
Figure 5:
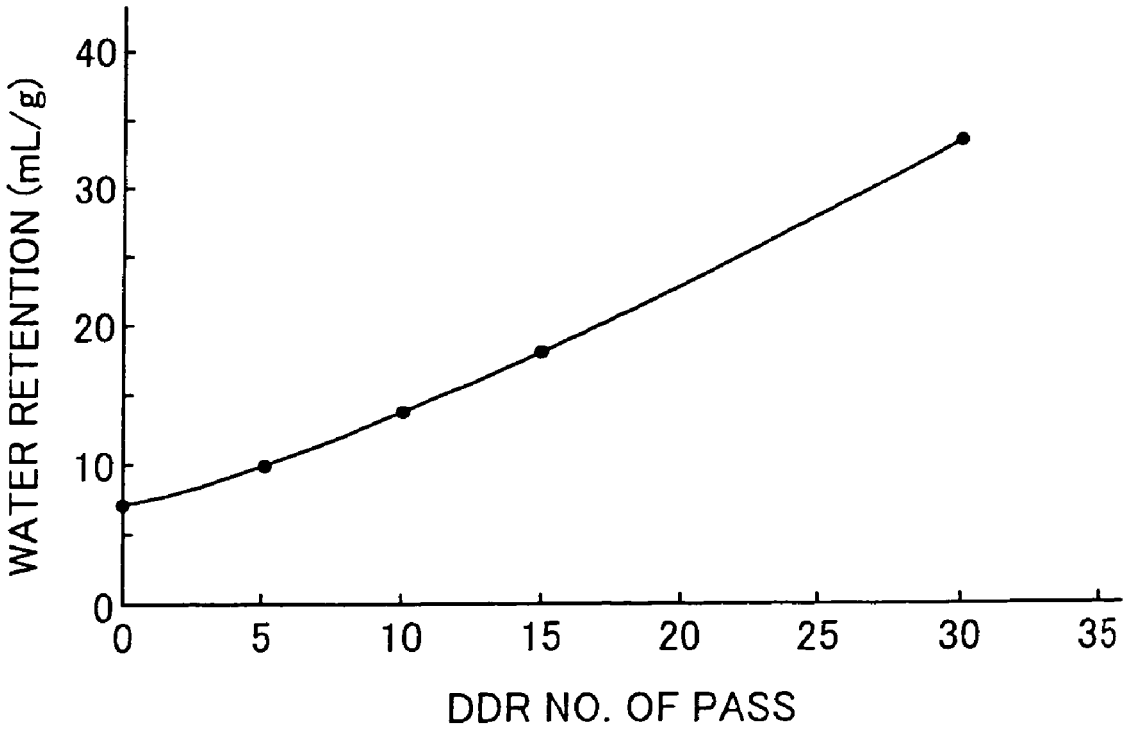
FIG. 5 is a chart showing an example of the relation between the number of passes of DDR and the water retention of obtained cellulose fibers.
Figure 6:
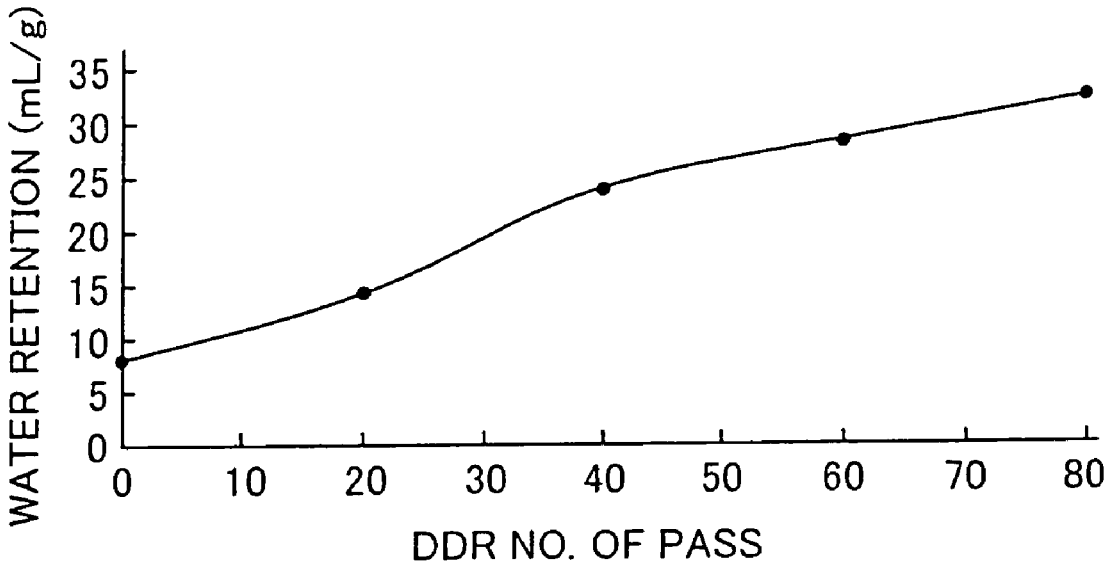
FIG. 6 is a chart showing another example of the relation between the number of passes of DDR and the water retention of obtained cellulose fibers.
Figure 7:
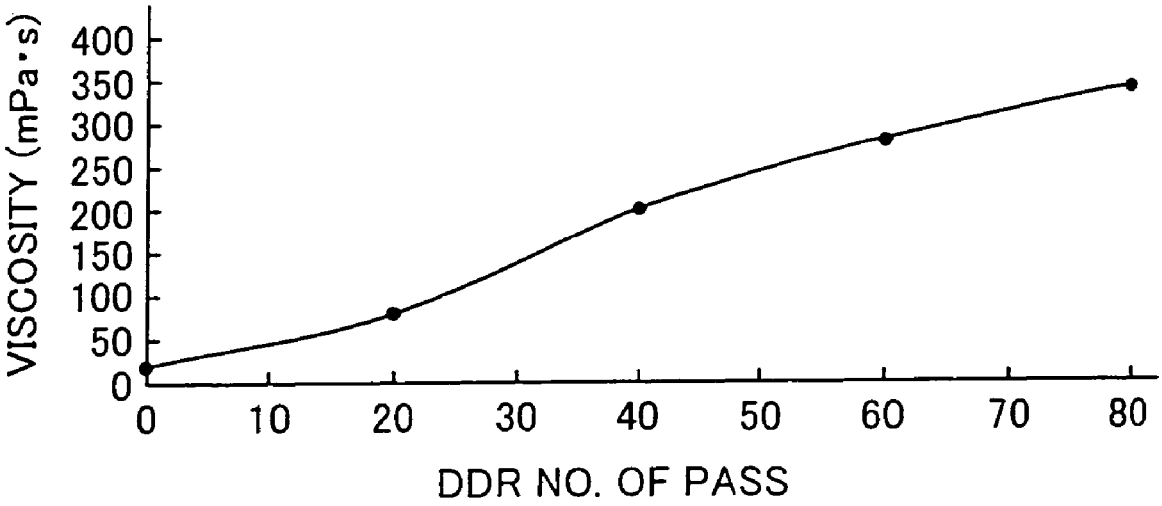
FIG. 7 is a chart showing an example of the relation between the number of passes of DDR and the viscosity of water dispersion liquid of obtained cellulose fibers.

FIGS. 2 to 7 are charts showing the relations between the number of treatments (number of passes) by DDR and the characteristics of obtained cellulose fibers in case DDR is used as a disc refiner. (Note that FIGS. 2, 3 and 5 show the results of example 1 to be discussed later and FIGS. 4, 6 and 7 show the results of example 3 to be discussed later.) Each of them will be explained below:

FIG. 2 is a chart showing an example of the relation between the number of passes of DDR and the freeness of the obtained cellulose fibers. Freeness may be measured in accordance with T-227 of TAPPI.

As shown in FIG. 2, the freeness is approximately 100 mL when the number of passes is 10. If the number of passes is over 10, gelation progresses so filtration cannot be performed and a part of fibers being shortened passes the mesh of a freeness tester, so the freeness can hardly be measured. Therefore, the freeness is not a preferable indicator for the characteristics of microfibrillated cellulose fibers obtained according to the present invention.

FIG. 3 is a chart showing an example of the relation of the number of passes of DDR and the number average fiber length of obtained cellulose fibers. The number average fiber length may be measured in accordance with JAPAN TAPPI Paper and Pulp Testing Methods No. 52 "Pulp and Paper—Fiber Length Testing Method—Automated Optical Measuring Method". Specifically, for example, Kajaani fiber length distribution measuring apparatus available from Kajaani, Finland, may be used for this purpose.

As shown in FIG. 3, the number average fiber length is approximately 0.5 mm when the number of passes is zero (i.e., no treatment performed), and the number average fiber length is approximately 0.2 mm when the number of passes is ten. From zero to ten passes, the number average fiber length gets rapidly shorter. When the number of passes is more than ten, as gelation progresses, the number average fiber length gets gradually lowered to 0.1 to 0.2 mm. With more than ten passes, microfibrillation of fibers (phenomenon where cellulose fibers are branched into microfibrillated fibers) primarily takes place, rather than shortening of fibers, which may have caused the gelation.

FIG. 4 is a chart showing another example of the relation between the number of passes of DDR and the number average fiber length of obtained cellulose fibers. As shown in FIG. 4, the number average fiber length gets shorter to a certain level (in this case approximately 0.15 mm), but hardly goes down further.

FIG. 5 is a chart showing an example of the relation between the number of passes of DDR and the water retention of obtained cellulose fibers. In the present invention, the "water retention" is a value expressing the volume of water which can be retained by a unit weight of cellulose fibers, and specifically it can be obtained as follows:

That is, the water retention is a value obtained by the following formula (1) when 50 mL of water dispersion liquid of cellulose fibers whose temperature is 20° C. and concentration is 1.5 wt % is taken in a centrifugal test tube (inside diameter 30 mm×length 100 mm, scaled volume 50 mL), centrifuged for 10 minutes at 2000 G (3300 rpm) and the volume of the precipitate is read. Note that the absolute dry weight of the cellulose fibers is obtained by weighing the precipitate when it reaches a constant weight after thermally dried.

$$\text{Water retention (mL/g)} = \text{volume of precipitate (mL)} / \text{absolute dry weight of cellulose fibers (g)} \quad (1)$$

As shown in FIG. 5, the water retention is 10 mL/g or less when the number of passes of DDR is zero, and it gets over 10 mL/g when the number of passes is ten. From zero to ten passes, the change of the water retention is less than that of the freeness and the number average fiber length. This is probably because fibers primarily are being made into shorter fibers and they are not very much microfibrillated. And subsequently, even when the number of passes is more than 10, the water retention continues to be increased. This is probably because fibers are being microfibrillated.

FIG. 6 is a chart showing another example of the relation between the number of passes of DDR and the water retention of cellulose fibers. Also in a case shown in FIG. 6, as the number of passes is increased, the water retention is increased and when the number of passes is 80, the water retention is over 30 mL/g, but the increasing rate of the water retention gets smaller around the number of passes of 80.

The inventors considered that it would be suitable to use the above-mentioned water retention in addition to a generally used number average fiber length as an indicator to express the degree of microfibrillation of fibers, and thus defined the microfibrillated cellulose fibers using the number average fiber length and the water retention.

Note that this water retention has a tendency to be identical with that of the viscosity (rotating viscosity) of water dispersion liquid of cellulose fibers. FIG. 7 is a chart showing an example of the relation between the viscosity of the water dispersion liquid of obtained cellulose fibers, which is the same example as shown in FIG. 6. Apparently from the comparison of FIGS. 6 and 7, the viscosity of water dispersion liquid of cellulose fibers changes just like the water retention as the number of passes is increased. The measurement of viscosity, however, is more complicated than that of the water retention, so in executing the manufacturing method according to the present invention, the manufacturing process is preferably controlled using the water retention.

In addition, as described above, by repeating the treatment with a disc refiner more than 10 times or preferably more than 20 times, microfibrillated cellulose fibers of 0.2 mm or less number average fiber length and 10 mL/g or more water retention can be obtained.

<Microfibrillated Cellulose Fibers>

By a method for the manufacture of microfibrillated cellulose fibers according to the present invention, microfibrillated cellulose fibers of the present invention can be obtained.

Microfibrillated cellulose fibers according to the present invention are 0.2 mm or less in number average fiber length and preferably 0.1 to 0.2 mm in number average fiber length. In addition, the water retention of microfibrillated cellulose fibers according to the present invention is 10 mL/g or more and preferably 20 mL/g or more and more preferably 25 to 35 mL/g.

If the number average fiber length and the water retention of microfibrillated cellulose fibers are within the above-mentioned ranges, such fibers are so stable that if their water dispersion liquid is allowed to stand even for one week at a room temperature, it would not give a phase separation (liquid and solid) due to the precipitation of microfibrillated cellulose fibers.

<Apparatus for Manufacturing Microfibrillated Cellulose Fibers>

A method for the manufacture of microfibrillated cellulose fibers according to the present invention can be carried out using any conventional known disc refiner. For example, the method can be carried out using apparatuses for the manufacture of microfibrillate cellulose fibers according to the present invention (hereinafter "the manufacturing apparatus of the present invention") described below.

A first embodiment of the manufacturing apparatus of the present invention is provided with a defibrating device, a circulation bath connected to said defibrating device, a disc refiner having an inlet and an outlet with said inlet being connected to said circulation bath and a reservoir bath connected to said outlet of said disc refiner.

The defibrating device is to defibrate supplied pulp sheets and make it into a slurry. The details of the defibrating device are as described above.

The circulation bath is to temporarily store the slurry. As the circulation bath, a conventional known tank can be used.

The disc refiner is to treat the slurry supplied from the circulation bath. The details of the disc refiner are as described above.

The outlet of the disc refiner is connected to the circulation bath and to the reservoir bath.

Note that the disc refiner has an inlet and an outlet with the inlet being connected to the circulation bath and with the outlet being connected to the reservoir bath and to the circulation bath, and if multiple of disc refiners are arranged in series, only the inlet of a disc refiner arranged at the most upstream side may be connected to the circulation bath and only the outlet of a disc refiner arranged at the most downstream side may be connected to the reservoir bath and the circulation bath.

Also, in case multiple of circulation baths and multiple of disc refiners are respectively arranged, combinations of the circulation bath and the disc refiner may be arranged in series, wherein only the circulation bath at the most upstream side may be connected to the defibrating device and only the outlet of the disc refiner at the most downstream side may be connected to the reservoir.

Slurry treated with a disc refiner is first supplied to a circulation bath and then to a disc refiner. Thus, the slurry is treated by the disc refiner circularly.

After the number of times of treatment becomes 10 or more, at a prescribed timing, for example, at the time when the cellulose fibers contained in the treated slurry have obtained a prescribed number average fiber length and/or a prescribed water retention, the treated slurry is supplied to the reservoir bath where the slurry is stored.

As the reservoir bath, any conventional known tank may be used.

A second embodiment of the manufacturing apparatus of the present invention is provided with a defibrating device, a disc refiner having an inlet and an outlet with said inlet being connected to said defibrating device and a reservoir bath connected to said outlet of said disc refiner.

The second embodiment of the manufacturing apparatus of the present invention is the same as the above-described first embodiment of the manufacturing apparatus of the present invention, except that the defibrating device serves both as the defibrating device and the reservoir bath of the first embodiment of the manufacturing apparatus of the present invention. As the defibrating device, a defibrating device same as used in the first embodiment of the manufacturing apparatus of the present invention can be used, and a large capacity apparatus with respect to the quantity of the slurry when defibrated is preferably used because in such large capacity apparatus it is possible to particularly obtain the high concentration at the time of defibrating of 5 to 10 wt % and to dilute the slurry down to the concentration of 1 to 6 wt % using the same defibration device after the defibrating operation.

FIGS. 8(A) to (G) show illustrations of various embodiments of the manufacturing apparatus of the present invention. The embodiments of FIGS. 18(A), (B), (C), (F) and (G) correspond to the above-described first embodiment of the manufacturing apparatus of the present invention, and those of FIGS. 18(D) and (E) correspond to the above-described second embodiment of the manufacturing apparatus of the present invention. The manufacturing apparatus of the present invention is explained below with reference to FIGS. 18, but the present invention is not limited to those embodiments. For example, a single disc refiner may be used instead of a DDR.

Figure 8:
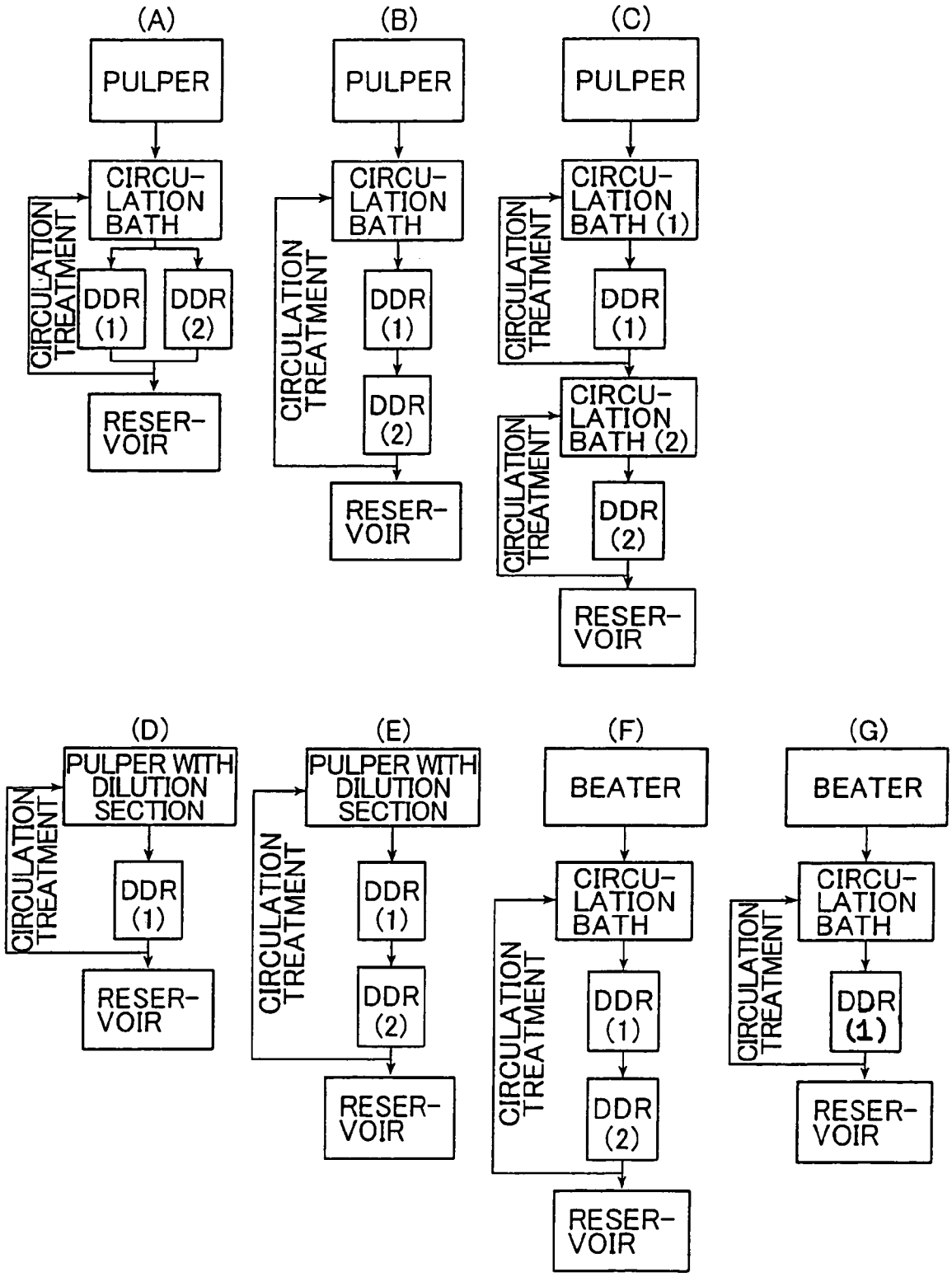
FIGS. 8(A) to (G) are illustrations showing various arrangements of respective manufacturing apparatuses according to the present invention.

In FIGS. 8(A), (B) and (C), as a defibrating device a conventional known pulper is used.

In FIG. 8(A), two DDR's are provided in parallel between the circulation bath and the reservoir bath as connected to both baths. By thus providing multiple of DDR's in parallel, the amount of manufactured microfibrillated cellulose fibers can be increased per unit of time.

FIG. 8(B), two DDR's are provided in series between the circulation bath and the reservoir bath as connected to both bathes. By thus providing multiple of DDR's in series, the number of times of circulating the slurry through the DDR's can be reduced. Specifically, for example, for performing 10 times of treatment with a DDR, circulating the slurry through the DDR's five times is sufficient. As a result, the amount of manufactured microfibrillated cellulose fibers can be increased per unit of time.

FIG. 8(C), between the pulper and the reservoir bath two circulation baths (1) and (2) and two DDR's (1) and (2) are connected alternately. The slurry which has been treated in the DDR (1) can be supplied to the circulation bath (1) and the slurry which has been treated in the DDR (2) can be supplied to the circulation bath (2). Thus, by providing multiple of circulation baths and multiple of DDR's alternately, the treating conditions for each of the DDR's can be made different so that microfibrillated cellulose fibers of desired characteristics may be obtained.

In FIGS. 8(D) and (E), as the defibrating device a pulper provided with a dilution section is used. The pulper provided with a dilution section may be of a large capacity with respect to the quantity of slurry at the time of defibration, as discussed above, and may be a conventional pulper as modified to have a space for dilution.

In FIG. 8(D), between the pulper provided with a dilution section and the reservoir bath, one DDR is provided as connected to the pulper and the reservoir bath. In case thus one DDR is used, the time of treatment gets longer than in case multiple of DDR's are used, but the apparatus may be of a small size and the cost for the capital investment may be smaller.

In FIG. 8(E), two DDR's are provided in series as connected between the pulper with the dilution section and the reservoir bath. As in FIG. 8(B), by providing multiple of DDR's in series, the number of times of circulating the slurry through the DDR's can be reduced.

In FIGS. 8(F) and (G), a conventional and known beater is used as the defibrating device.

In FIG. 8(F), two DDR's are provided in series as connected between the circulation bath and the reservoir bath. As in FIG. 8(B), by providing multiple of DDR's in series, the number of times of circulating the slurry through the DDR's can be reduced.

In FIG. 8(G), one DDR is connected between the circulation bath and the reservoir bath. As in FIG. 8(D), the size of the apparatus can be made smaller and accordingly the cost for the capital investment may be made smaller.

EXAMPLES

The present invention will be specifically explained below with the examples shown, but is not limited to the following examples.

Example 1

1. Manufacturing of Microfibrillated Cellulose Fibers

By using the manufacturing apparatus of the present invention comprising a pulper, a circulation bath and two DDR's provided in series as shown in FIG. 8(B), microfibrillated cellulose fibers were manufactured.

(1) Defibration Step

A pulper of 6 $m^3$ capacity (manufactured by Aikawa Tekkou Co., Ltd.) was filled with water of 5.5 $m^3$ and as the water was made to circulate, LBKP sheet (manufactured by Domtar Inc., U.S. under the trademark "St. Croix") of 400 kg (absolute dry weight being 354 kg) whose water content is 11.5 wt % was put into the pulper.

Then, 0.1 $m^3$ of water was added to adjust the concentration of slurry to 5.9 wt % and then defibration was performed. At that time, the temperature of the slurry was 18° C.

After the defibration was continued for 15 minutes, the slurry was transferred to the circulation bath. The transfer of the liquid was performed as water was being added to the pulper.

(2) Step of Treating with Disc Refiner (i) Adjusting of Concentration of Slurry

Water was added to make the concentration of the slurry in the circulation bath 4.0 wt %. In other words, the volume of the slurry in the circulation bath was made 8.85 $m^3$.

(ii) Specifications of DDR (a) DDR Body

DDR (1) : AWN 20 model 190 kW (manufactured by Aikawa Tekkou Co., Ltd.).

DDR (2) : AWN 20 model 190 kW (manufactured by Aikawa Tekkou Co., Ltd.).

(b) Disc Plate

DDR (1) : blade width 2.0 mm, groove width 3.0 mm, ratio of blade width to groove width 0.67.

DDR (2) : blade width 3.5 mm, groove width 2.0 mm, ratio of blade width to groove width 1.75.

(iii) Treatment Conditions

With the DDR's of the above-mentioned specifications used, the treatment of slurry with a disc refiner was performed. For the treatment, the flow was set at 0.80 $m^3$/min, and the load conditions were changed depending on the treatment time as shown in Table 2 below. The number of times of passes through the DDR's was calculated from the flow and the treatment time.

TABLE 2

| Treatment time (min) | 0 to 27.5 | 27.5 to 5.55 | 55 to 165 | 165 to 275 |
|---|---|---|---|---|
| No. of passes through DDR (times) | 1 to 5 | 6 to 10 | 11 to 20 | 21 to 30 |
| Loads of DDR (1) (kW) | 165 | 160 | 40 (Disc plate in released state) | 40 (Disc plate in released state) |
| Loads of DDR (2) (kW) | 160 | 155 | 155 | 150 |

2. Evaluation of Microfibrillated Cellulose Fibers

When the number of passes of DDR's is 0, 5, 10, 15 and 30, respectively, a sample slurry of 1 L each taken from the slurries obtained by the treatment was measured in terms of number average fiber length, water retention, and freeness.

Also, the sample taken from the slurry at the number of passes of 30 was measured in terms of fiber length distribution and viscosity and stability over time of water dispersion liquid in addition to number average fiber length, water retention and freeness.

The measuring methods are described below:

(1) Number Average Fiber Length and Fiber Length Distribution

From the above-mentioned samples, an extremely small amount of slurry was taken with a spatula and ion exchange water was added to obtain a diluted slurry of approximately 0.03 wt %. This diluted slurry was taken into a beaker of 500 mL capacity to make a test sample.

The number average fiber length and the fiber length distribution were measured using Kajaani's fiber length distribution measuring apparatus. (manufactured by Kajaani, Finland) in accordance with JAPAN TAPPI Paper and Pulp Testing Methods No. 52 "Pulp and Paper—Fiber Length Testing Methods—Automated Optical Measuring Method".

The number average fiber length was obtained by adding the lengths of all the cellulose fibers existent in a sample and dividing the sum by the number of fibers.

In addition, the percentages of fibers as so added was calculated with a pitch of 0.10 mm between 0.00 mm and 3.00 mm, and ratios of the number of cellulose fibers whose number average fiber length is 0.30 mm or longer and of the number of cellulose fibers whose number average fiber length is 0.20 mm or shorter against the total number of cellulose fibers, respectively, were calculated.

(2) Retention of Water

Slurry of approximately 200 mL was taken from the above-mentioned sample, and ion exchange water was added to obtain a diluted slurry of 1.5 wt %. This diluted slurry was taken into a beaker of a 500 mL capacity and adjusted to the temperature of 20° C., which was used as the test sample.

50 mL of the test sample was measured and taken into a centrifugal test tube (inside diameter 30 mm×length 100 mm, scaled volume 50 mL), centrifuged for 10 minutes at 2000 G (3000 rpm) and then the volume of the precipitate was read, and the water retention was obtained using the above formula (1). Note that the absolute dry weight of cellulose fibers was obtained by weighing the precipitate when it reaches a constant weight after thermally dried.

(3) Freeness

Slurry of approximately 100 mL was taken from the above-mentioned sample, and ion exchange water was added to obtain a diluted slurry of 0.3 wt %. This diluted slurry of 1000 mL was accurately measured and taken into a measuring cylinder of 1000 mL capacity to make a test sample. The test sample was measured for temperature with the 0.5° C. accuracy.

The freeness of the test sample was measured in accordance with the standard T-227 of TAPPI. Specifically, the quantity of water discharged from the lateral tube was measured with a measuring cylinder, which was corrected to the standard temperature 20° C. in accordance with the temperature of the test sample, which was understood to be the freeness (mL).

(4) Viscosity of Water Dispersion Liquid

Slurry of approximately 60 mL was taken from the above-mentioned sample, and ion exchange water was added to obtain a diluted slurry of 0.50 wt %. This diluted slurry of 500 mL was taken into a beaker of 200 mL capacity and was adjusted to be 20° C. to obtain the test sample.

The viscosity of the test sample was measured with a Brookfield type rotary viscometer which is a single cylinder type rotary viscometer as defined in JIS Z8803 "Viscosity Measuring Methods". The measurements were performed using a No. 2 rotor rotating at 12 rpm and the value at 30 seconds after the start of rotation was taken as the viscosity (mPa.s). The measurements were repeated five times and their average was calculated.

(5) Stability over Time of Water Dispersion Liquid

Slurry of approximately 30 mL was taken from the above-mentioned sample, and ion exchange water was added to obtain diluted slurry of 0.50 wt %. 200 mL of this diluted slurry was accurately measured and taken into a measuring cylinder of a 200 mL capacity. The opening portion of the measuring cylinder was sealed to prevent water from evaporating. Subsequently, the measuring cylinder was placed and allowed to stand in a bath controlled to be at 20° C. to adjust the temperature of the measuring cylinder.

After 24 hours, the volume (h) of the clear supernatant liquid was read visually and by the following formula (2) the precipitation rate was obtained. The lower the precipitation rates, the better the stability over time is.

$$\text{Precipitation rate (\%)} = h\ (\text{mL})/200\ (\text{mL}) \times 100 \quad (2)$$

The results of evaluation are shown in FIGS. 2, 3 and 5 and in Table 3.

As clearly shown in FIGS. 2, 3 and 5 and in Table 3, by carrying out the manufacturing method of the present invention, microfibrillated cellulose fibers whose number average fiber length is 0.2 mm or less and whose water retention is 10 mL/g or more could be obtained.

In addition, 95% or more of microfibrillated cellulose fibers obtained by the manufacturing method of the present invention (the number of passes of DDR being 30) are 0.20 mm in fiber length, which shows that the present invention is capable of producing short fibers stably. Furthermore, the viscosity of its water dispersion liquid is 150 mPa.s at the condition that the dispersion has been diluted to 0.50 wt %, which shows that such obtained fibers have been made highly viscous. Furthermore, the stability over time of such water dispersion liquid is 2.0% in terms of precipitation after 24 hours, which shows that the stability is extremely high.

TABLE 3

| | |
|---|---|
| Number average fiber length (mm) | 0.16 |
| Fiber length distribution | 0.30 mm or more: 1% or less<br>0.20 mm or less: 95% or more |
| Water retention (mL/g) | 31 |
| Viscosity of 0.50 wt % water dispersion liquid (20° C.) mPa · s | 150 |
| Stability over time of water dispersion liquid (20° C.) (precipitation rate (%)) | 2.0 |

Example 2

1. Manufacturing of Microfibrillated Cellulose Fibers

Microfibrillated cellulose fibers were manufactured using the manufacturing apparatus of the present invention comprising a pulper provided with a dilution section, one DDR and a reservoir bath, as shown in FIG. 8(D).

(1) Defibration Step

A pulper (manufactured by Aikawa Tekkou Co., Ltd.) of a 9 $m^3$ total capacity whose number of agitating rotations can be inverter controlled having a pulper section of a 6 $m^3$ capacity and a dilution section of a 3 $m^3$ capacity was filled with water of 5.6 $m^3$, and as the water was circulated, 409 kg (absolute dry weight being 354 kg) of lavatory paper stock (manufactured by Oji Paper Mfg. Co., Ltd.), which was a pulp beaten and fibrillated having a water content of 13.4 wt %, was put into the pulper and defibrated therein. The agitation in the defibrating operation was at the maximum number of revolution. The concentration of the slurry was 5.9 wt % and the temperature was 18° C.

After the defibrating operation was performed for 15 minutes, dilution water was put into the slurry to adjust the concentration to 4.5 wt %.

(2) Step of Treating with Disc Refiner (i) Specifications of DDR (a) DDR Main Body AWN 20 model 190 kW (manufactured by Aikawa Tekkou Co., Ltd.)

(b) Disc Plate

Blade width 2.5 mm, groove width 2.5 mm, and ratio of blade width to groove width 1.00.

(ii) Treatment Conditions

Using the DDR of above-described specifications, the disc refiner treatment of slurry was performed. For this treatment, the flow rate was set at 0.80 $m^3$/min, and the load conditions were changed depending upon the treatment time as shown in Table 4 below. The numbers of passes of DDR given in Table 4 were calculated from the flow rate and the treatment time.

TABLE 4

| | | | |
|---|---|---|---|
| Treatment time (min) | 0 to 49 | 49 to 98 | 98 to 295 |
| No. of passes of DDR (times) | 1 to 5 | 6 to 10 | 11 to 30 |
| Loads of DDR (kW) | 165 | 160 | 155 |

2. Evaluation of Microfibrillated Cellulose Fibers

When the number of passes of DDR's is 0, 5, 10, 15 and 30, respectively, a sample slurry of 1 L each taken from the slurries obtained by the treatment was measured in terms of number average fiber length.

Also, the sample taken from the slurry at the number of passes of 30 was measured in terms of fiber length distribution and water retention, as well as viscosity and stability over time of water dispersion liquid in addition to number average fiber length.

The measuring methods are the same as applied in example 1 above.

Figure 9:
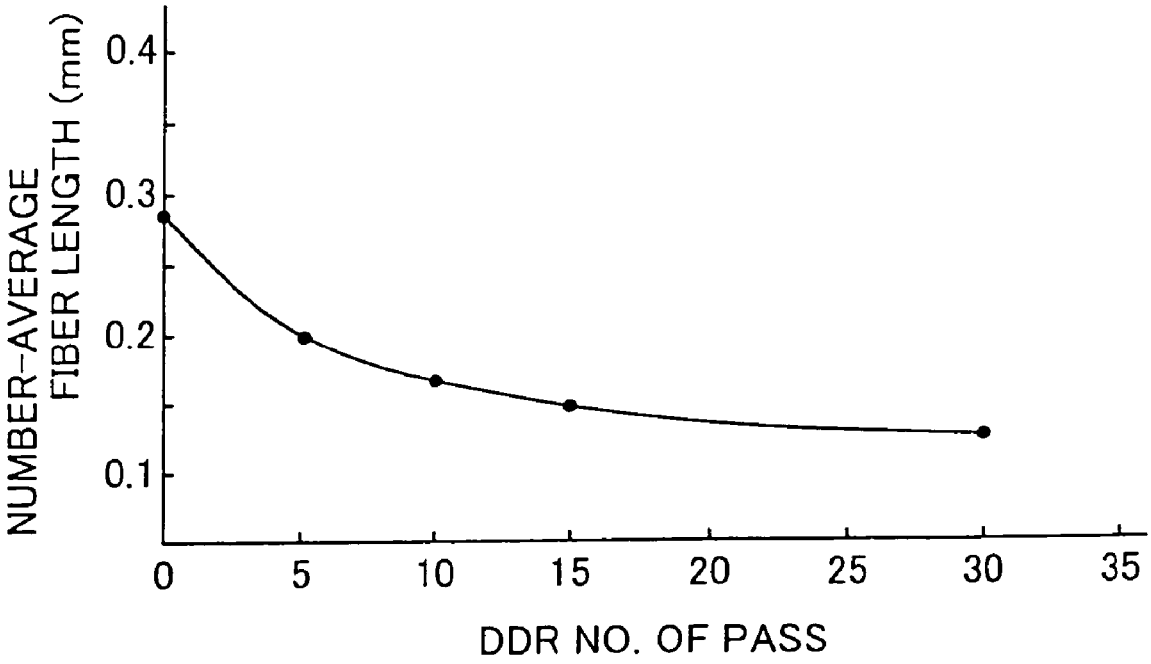
FIG. 9 is a chart showing the relation between the number of passes of DDR and the number average fiber length of obtained cellulose fibers in Example 2.

The results of evaluation are shown in FIG. 9 and Table 5.

As clearly shown in FIG. 9 and Table 5, by carrying out the manufacturing method of the present invention, microfibrillated cellulose fibers whose number average fiber length is 0.2 mm or less and whose water retention is 10 mL/g or more could be obtained.

In addition, 95% or more of microfibrillated cellulose fibers obtained by the manufacturing method of the present invention (the number of passes of DDR being 30) are 0.20 mm in fiber length, which shows that the present invention is capable of producing short fibers stably. Furthermore, the viscosity of its water dispersion liquid is 140 mPa.s at the condition that the dispersion has been diluted to 0.50 wt %, which shows that such obtained fibers have been made highly viscous. Furthermore, the stability over time of such water dispersion liquid is 2.0% in terms of precipitation after 24 hours, which shows it is extremely stable.

Note that the number of passes of DDR even in case of pulp already beaten and fibrillated (example 2) was not much different from that in case of unbeaten pulp (example 1), in terms of the number of passes of DDR at the time when the number average fiber length reached 0.2 mm or less.

TABLE 5

| | |
|---|---|
| Number average fiber length (mm) | 0.15 |
| Fiber length distribution | 0.30 mm or more: 1% or less<br>0.20 mm or less: 95% or more |
| Water retention (mL/g) | 31 |
| Viscosity of 0.50 wt % water dispersion liquid (20° C.) (mPa · s) | 140 |
| Stability over time of water dispersion liquid (20° C.) (precipitation rate (%)) | 2.0 |

Example 3

1. Manufacturing of Microfibrillated Cellulose Fibers

Microfibrillated cellulose fibers were manufactured with the manufacturing apparatus of the present invention comprising a pulper provided with a dilution section, two DDR's arranged in series and a reservoir bath, as shown in FIG. 8(E).

(1) Defibration Step

A pulper (manufactured by Aikawa Tekkou Co., Ltd.) of an 8 $m^3$total capacity whose number of agitating rotations can be inverter controlled having a pulper section of a 6 $m^3$ capacity and a dilution section of a 2 $m^3$ capacity was filled with water of 2.77 $m^3$, and as the water was circulated, 200 kg (absolute dry weight being 177 kg) of LBKP sheet (manufactured by Domtar, Inc., U.S., under the trademark "St. Croix"), whose water content is 11.5 wt %, was put into the pulper and defibrated therein at the slurry concentration of 6.0 wt %. The temperature of the slurry at this time was 20° C.

After the defibrating operation was performed for 15 minutes, water was added to adjust the slurry concentration to 2.95 wt %. The total volume of the slurry in the pulper was 6.0 $m^3$.

(2) Step of Treating with Disc Refiner (i) Specifications of DDR

DDR (1) and DDR (2) had the same specification as below in terms of the DDR main body and the disc.

(a) DDR Main Body

AWN 14 model 75 kW (manufactured by Aikawa Tekkou Co., Ltd.)

(b) Disc Plate

Blade width 2.0 mm, groove width 3.0 mm, and ratio of blade width to groove width 0.67.

(ii) Treatment Conditions

Using the DDR's of above-described specifications, the disc refiner treatment of slurry was performed. For this treatment, the flow rate was set at 0.50 $m^3$/min, and the clearance (as indicated) was increased depending upon the treatment time as shown in Table 6 below. This was for the purpose of applying an appropriate shear to the cellulose fibers taking into consideration of possible thermal expansion caused by elevation in temperature. The number of passes of DDR given in Table 6 were calculated from the flow rate and the treatment time.

TABLE 6

| | | | | | | | |
|---|---|---|---|---|---|---|---|
| No. of passes of DDR | 1 to 10 | | 11 to 22 | | | 21 to 80 | |
| Treatment time (min) | 0 to 60 | 60 to 80 | 80 to 95 | 95 to 120 | 120 to 150 | 150 to 250 | 250 to 480 |
| Clearance between DRR(1) and (2) (mm) | 0.18 | 0.20 | 0.22 | 0.24 | 0.24 | 0.27 | 0.30 |
| Temperature of slurry (° C.) | 22(start) 32(60 min) | 39 (80 min) | 48 (95 min) | 55 (120 min) | 60 (150 min) | 66 (250 min) | 70 (480 min) |

2. Evaluation of Microfibrillated Cellulose Fibers

When the number of passes of DDR's is 0, 20, 40, 60 and 80, respectively, a sample slurry of 1 L each taken from the slurries obtained by the treatment was measured in terms of number average fiber length, water retention and viscosity of water dispersion liquid.

The measuring methods are the same as applied in example 1 above.

The results of evaluation are shown in FIGS. 4, 6 and 7.

As clearly shown in FIGS. 4 and 6, by carrying out the manufacturing method of the present invention, microfibrillated cellulose fibers whose number average fiber length is 0.2 mm or less and whose water retention is 10 mL/g or more could be obtained.

In this example, the number average fiber length rapidly shortened until the number of passes of DDR's increased up to 20 times, but beyond that, the number average fiber length did not get shorter significantly and was kept almost constant at approximately 0.15 mm (See FIG. 4).

Also, the water retention and the viscosity of water dispersion liquid showed a similar tendency, and increased gradually depending upon the number of passes of DDR's. (See FIGS. 6 and 7).

After the defibrating operation was performed for 15 minutes, water was added to adjust the slurry concentration to 3.0 wt %. In other words, the quantity of the slurry in the pulper was 3.0 $m^3$.

(2) Step of Treating with Disc Refiner (i) Specifications of DDR (a) DDR Main Body AWN 14 model 75 kW (manufactured by Aikawa Tekkou Co., Ltd.)

(b) Disc Plate

Blade width 2.0 mm, groove width 3.0 mm, and ratio of blade width to groove width 0.67.

(ii) Treatment Conditions

Using the DDR of above-described specifications, the disc refiner treatment of slurry was performed. For this treatment, the flow rate was set at 0.50 $m^3$/min, and the clearance (as indicated) was changed depending upon the treatment time as shown in Table 7 below. The DDR during the operation in the released state had a clearance of 11.2 mm and a load of 130 A. The numbers of passes of the DDR given in Table 7 were calculated from the flow rate and the treatment time.

TABLE 7

| | | | | | | |
|---|---|---|---|---|---|---|
| No. of passes of DDR (times) | 1 to 20 | | 21 to 55 | | 56 to 90 | |
| Treatment time (min) | 0 to 120 | 120 to 150 | 150 to 280 | 280 to 330 | 330 to 410 | 410 to 540 |
| Clearance of DDR (mm) | 0.12 | 0.12 | 0.15 | 0.18 | 0.21 | 0.24 |
| Loads of DDR (A) | 245(start) 150(120 min) | 140 (150 min) | 130 (280 min) | 130 (330 min) | 130 (410 min) | 130 (540 min) |
| Temperature of slurry (° C.) | 0(start) 45(120 min) | 52 (150 min) | 57 (280 min) | 64 (330 min) | 68 (410 min) | 72 (540 min) |

Example 4

1. Manufacturing of Microfibrillated Cellulose Fibers

Microfibrillated cellulose fibers were manufactured with the manufacturing apparatus of the present invention comprising a pulper provided with a dilution section, one DDR and a reservoir bath, as shown in FIG. 8(D).

(1) Defibration Step

A pulper (manufactured by Aikawa Tekkou Co., Ltd.) of a 3.5 $m^3$total capacity whose number of agitating rotations can be inverter controlled having a pulper section of a 2 $m^3$ capacity and a dilution section of a 1.5 $m^3$ capacity was filled with water of 1.79 $m^3$, and as the water was circulated, 102 kg (absolute dry weight being 90 kg) of LBKP sheet (manufactured by Domtar, Inc., U.S., under the trademark "St. Croix"), whose water content is 12.0 wt %, was put into the pulper and defibrated therein at the slurry concentration of 5.0 wt %. The temperature of the slurry at this time was 21° C.

2. Number of Passes of DDR

In Table 7 the number of passes of DDR, the treatment time, the clearance of DDR, the load of DDR and the temperature of slurry are shown.

As shown in Table 7, the more the number of passes of DDR increased, the harder the application of the load became, and specifically when the number of passes of DDR was beyond 50, only the load same as that applied during the operation in the released state of disc plates could be applied, but the process control for the manufacture of microfibrillated cellulose fibers with the method of the present invention could easily be realized by appropriately controlling the clearance taking the degree of microfibrillation of cellulose fibers, thermal expansion of disc plate and the like into consideration.

3. Evaluation of Microfibrillated Cellulose Fibers

When the number of passes of DDR's is 0, 20, 40, 60 and 80, respectively, a sample slurry of 1 L each taken from the slurries obtained with the treatment was measured in terms of number average fiber length, water retention and viscosity of water dispersion liquid.

The measuring methods are the same as applied in example 1 above.

The results of evaluation are not shown, but were almost identical with those shown in example 3 above in FIGS. 4, 6 and 7.

The invention claimed is:

1. A method for the manufacture of microfibrillated cellulose fibers of 0.2 mm or less in terms of number average fiber length and of 20 mL/g or more in terms of water retention indicating the volume of water which can be retained by a unit weight of cellulose fibers, by subjecting slurry containing pulp of solid component concentration of 1 to 6 wt % to treatment with a disc refiner at 10 times or more.

2. A method for the manufacture of microfibrillated cellulose fibers according to claim 1, wherein said treatment with a disc refiner is performed 30 to 90 times.

3. A method for the manufacture of micro fibrillated cellulose fibers according to claim 1, wherein the number average fiber length of said microfibrillated cellulose fibers is 0.1 to 0.2 mm and the water retention of said microfibrillated cellulose fibers is 25 to 35 mL/g.

4. A method for the manufacture of micro fibrillated cellulose fibers according to claim 1, wherein the solid component concentration of said slurry is 1 to 4 wt %.

5. A method for the manufacture of microfibrillated cellulose fibers according to claim 4, wherein said slurry is slurry obtained by dilution with ethanol or a mixture of ethanol and water.

6. A method for the manufacture of microfibrillated cellulose fibers according to claim 1, wherein one disc refiner is employed.

7. A method for the manufacture of micro fibrillated cellulose fibers according to claim 1, wherein two disc refiners are employed and the total number of treatments with a first disc refiner and with a second disc refiner is 10 times or more, wherein after one time or more of said treatments with the first disc refiner are performed, one time or more of said treatments with the second disc refiner are performed.

8. A method for the manufacture of microfibrillated cellulose fibers according to claim 1, wherein two disc refiners are employed and the total number of treatments with a first disc refiner and with a second disc refiner is 10 times or more, wherein an operation in which after one time of said treatment with the first disc refiner is performed, one time of said treatment with the second disc refiner is performed is repeated 5 times or more.

9. A method for the manufacture of microfibrillated cellulose fibers according to claim 7, wherein said first disc refiner and said second disc refiner are of the same type.

10. A method for the manufacture of microfibrillated cellulose fibers according to claim 7, wherein said first disc refiner and said second disc refiner are different in at least one selected from a group consisting of the blade width, the groove width and the ratio of blade width to groove width of disc plate.

11. A method for the manufacture of microfibrillated cellulose fibers according to claim 1, wherein as said disc refiner, a disc refiner having a disc plate of 3.0 mm or less blade width and 1.0 or less ratio of blade width to groove width is employed.

12. A method for the manufacture of microfibrillated cellulose fibers according to claim 10, wherein as said first disc refiner, a disc refiner having a disc plate of 2.5 mm or less blade width and 1.0 or less ratio of blade width to groove width is employed and as said second disc refiner, a disc refiner having a disc plate of 2.5 mm or more blade width and 1.0 or more ratio of blade width to groove width is employed.

* * * * *